US010072886B2

(12) United States Patent
Koo et al.

(10) Patent No.: US 10,072,886 B2
(45) Date of Patent: Sep. 11, 2018

(54) REFRIGERATOR

(71) Applicant: Samsung Electronics Co., Ltd., Suwon-si (KR)

(72) Inventors: Keon Pyo Koo, Hwaseong-si (KR); Yong Bum Seo, Hwaseong-si (KR); Chun Youp Shin, Suwon-si (KR); Woo Yeol Yoo, Suwon-si (KR); Jeong Hyun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/416,517

(22) Filed: Jan. 26, 2017

(65) Prior Publication Data

US 2017/0261248 A1 Sep. 14, 2017

Related U.S. Application Data

(63) Continuation of application No. PCT/KR2016/009019, filed on Aug. 17, 2016.

(30) Foreign Application Priority Data

Sep. 1, 2015 (KR) ..... 10-2015-0123341

(51) Int. Cl.
*F25D 17/04* (2006.01)
*F25D 23/02* (2006.01)
*F25D 29/00* (2006.01)

(52) U.S. Cl.
CPC ..... *F25D 17/04* (2013.01); *F25D 23/028* (2013.01); *F25D 29/005* (2013.01); *F25D 2400/361* (2013.01)

(58) Field of Classification Search
CPC ..... F25D 23/02; F25D 23/028; F25D 17/04; F25D 29/005
(Continued)

(56) References Cited

U.S. PATENT DOCUMENTS 4,009,586 A * 3/1977 Skvarenina ..... F25D 21/04 248/596
7,155,923 B2 * 1/2007 Nam ..... F25D 29/005 165/80.3
(Continued)

FOREIGN PATENT DOCUMENTS

JP 9-250868 9/1997
JP 2004-271175 9/2004
(Continued)

OTHER PUBLICATIONS

International search Report dated Nov. 21, 2016 in corresponding International Patent Application No. PCT/KR2016/009019.
(Continued)

*Primary Examiner* — James Orville Hansen
(74) *Attorney, Agent, or Firm* — Staas & Halsey LLP

(57) ABSTRACT

Disclosed herein is an refrigerator. The refrigerator includes a body provided with a storage chamber, a door configured to open or close the storage chamber, a display unit provided on the door, and a heat radiating unit disposed adjacent to the display unit and configured to radiate a heat generated in the display unit via a heat radiating flow path formed inside the door, wherein one end of the heat radiating flow path is communicated with the outside via a first opening formed in an upper end portion of the door, and the other end of the heat radiating flow path is communicated with the outside via a second opening formed in a lower end portion of the door.

9 Claims, 7 Drawing Sheets

(58) Field of Classification Search
USPC ..... 312/401, 405, 405.1, 292; 62/125, 259.2
See application file for complete search history.

(56) References Cited

U.S. PATENT DOCUMENTS

| | | | | |
|---|---|---|---|---|
| 8,220,204 | B2 * | 7/2012 | Lee | F25D 23/02 312/405 |
| 2004/0177624 | A1 * | 9/2004 | Wo | F25D 23/02 62/125 |
| 2007/0056303 | A1 * | 3/2007 | Choi | F25D 23/028 62/259.2 |
| 2009/0293501 | A1 * | 12/2009 | Kulkarni | F25D 11/025 62/3.63 |
| 2012/0260683 | A1 * | 10/2012 | Cheon | F25D 29/00 62/125 |

FOREIGN PATENT DOCUMENTS

| | | |
|---|---|---|
| KR | 10-2005-0044169 | 5/2005 |
| KR | 10-2006-0035428 | 4/2006 |
| KR | 10-0638897 | 10/2006 |
| KR | 10-2007-0030643 | 3/2007 |
| KR | 10-2010-0067470 | 6/2010 |

OTHER PUBLICATIONS

Korean Office Action dated Mar. 27, 2017 in corresponding Korea Patent Application No. 10-2015-0123341, 11 pages.
Korean Office Action dated Jun. 8, 2017 in corresponding Korea Patent Application No. 10-2015-0123341, 4 pages.
Korean Office Action dated Jul. 25, 2017 in corresponding Korean Patent Application No. 10-2015-0123341, 4 pages.

* cited by examiner

REFRIGERATOR

CROSS-REFERENCE TO RELATED APPLICATIONS

This application is a continuation application of PCT International Patent Application No. PCT/KR2016/009019, filed Aug. 17, 2016 which claims the foreign priority benefit under 35 U.S.C. § 119 of 10-2015-0123341 filed Sep. 1, 2015, the contents of which are incorporated herein by reference.

TECHNICAL FIELD

Embodiments of the present disclosure relate to a refrigerator, more particularly, to a refrigerator to radiate a heat generated in a display unit provided in the refrigerator.

BACKGROUND ART

A refrigerator is a kind of apparatus to keep food fresh at a low temperature by supplying cold air at the low temperature to a storage chamber in which the food is stored, and the refrigerator is provided with a freezing compartment configured to keep food at under a freezing temperature and a refrigerating compartment configured to keep food at slightly over the freezing temperature.

The refrigerator may be classified by a type of a door, particularly classified into Top Mounted Freezer (TMF) type refrigerator having a storage chamber divided into an upper side and a lower side by a horizontal partition and thus a freezing compartment is formed in the upper side and a refrigerating compartment is formed in the lower side, and Bottom Mounted Freezer (BMF) type refrigerator in which a refrigerating compartment is formed in the upper side and a freezing compartment is formed in the lower side. In addition, the refrigerator may be classified into Side by Side (SBS) type refrigerator having a storage chamber divided into a left side and a right side by a vertical partition and thus a freezing compartment is formed in one side and a refrigerating compartment is formed in the other side, and French Door Refrigerator (FDR) type refrigerator having a storage chamber divided into an upper side and a lower side by a horizontal partition and thus a refrigerating compartment is formed in the upper side and a freezing compartment is formed in the lower side, wherein the refrigerating compartment is opened or closed by a pair of doors.

A display unit may be provided on a door of the refrigerator to display operation information of the refrigerator or to receive an input of a command of the operation of the refrigerator. The display unit may generate a heat when operated, and the heat may cause the reduction of an operation performance of the display unit. Therefore, it is desirable to radiate the generated heat to the outside.

To relieve difficulties, a method has been presented to conduct a heat generated in a display unit to a door of a refrigerator using a heat radiating panel, recently. However, in a state in which the heat radiation efficiency is not sufficient, when a user contacts the door, the heat may be delivered to the user. In addition, a method to radiate a heat using an air blower has been presented, but there are difficulties in that a noise is generated and a structure thereof is complicated.

DISCLOSURE

Technical Problem

Therefore, it is an aspect of the present disclosure to provide a refrigerator having an improved structure to efficiently radiate a heat generated in a display provided in the refrigerator.

Technical Solution

In accordance with one aspect of the present disclosure, a refrigerator includes a body provided with a storage chamber, a door configured to open or close the storage chamber, a display unit provided on the door, and a heat radiating unit disposed adjacent to the display unit and configured to radiate a heat generated in the display unit via a heat radiating flow path formed inside the door, wherein one end of the heat radiating flow path is communicated with the outside via a first opening formed in an upper end portion of the door, and the other end of the heat radiating flow path is communicated with the outside via a second opening formed in a lower end portion of the door.

A blocking unit may provide with a blocker configured to prevent a foreign material from being introduced into the heat radiating flow path and a through hole configured to allow air to be passed therethrough may be provided in at least one of the first opening and second opening.

The blocking unit may be detachably installed in the door.

The door may include an insulation member to prevent cold air of the storage chamber from being leaked, the heat radiating unit is disposed between the display unit and the insulation member.

A part of the heat radiating unit may be disposed to pass through the insulation member.

The heat radiating flow path may include a main flow path receiving a heat from the display unit and an auxiliary flow path discharging the heart transmitted from the main flow path to the outside via the first opening and second opening.

The heat radiating unit may include a heat radiating cover forming the main flow path and a heat radiating duct forming the auxiliary flow path.

The heat radiating cover may be disposed to cover a rear surface of the display unit.

The heat radiating duct may have a cross sectional area being reduced as the heat radiating cover becomes near to the outside.

The first opening may be disposed on an top surface of the door and the second opening may be disposed on a bottom surface of the door.

The display unit may be provided with a sensor to selectively activate the display unit.

The display unit may include a touch screen.

In accordance with another aspect of the present disclosure, a refrigerator includes a body provided with a storage chamber, a door configured to open or close the storage chamber and provided with an insulation member to prevent cold air of the storage chamber from being leaked, a display unit provided in the door, and a heat radiating unit is disposed adjacent to the display unit in the door and configured to radiate a heat generated in the display unit via a heat radiating flow path formed such that a part of the heat radiating flow path passes through the insulation member, so as to be communicated with the outside.

The heat radiating unit may include a heat radiating cover covering a rear surface of the display unit, and a heat radiating duct communicating the heat radiating cover with the outside.

The heat radiating cover may be disposed between the display unit and the insulation member, and the heat radiating duct may be disposed to pass through the insulation.

Advantageous Effects

In accordance with one aspect of the present disclosure, a refrigerator may discharges a heat generated by a display unit to the outside by circulating external air and internal air using the air convection, and thus an additional blower may be not needed. Accordingly, the noise may be reduced and the structure of the heat radiation may be simplified. In addition, the efficiency of the heat radiation may be improved and the electricity consumption of the refrigerator may be reduced. The electricity consumed by the blower may be saved and thus the entire electricity consumption may be reduced.

DESCRIPTION OF DRAWINGS

These and/or other aspects of the present disclosure will become apparent and more readily appreciated from the following description of the embodiments, taken in conjunction with the accompanying drawings of which.

BEST MODE

Figure 1:
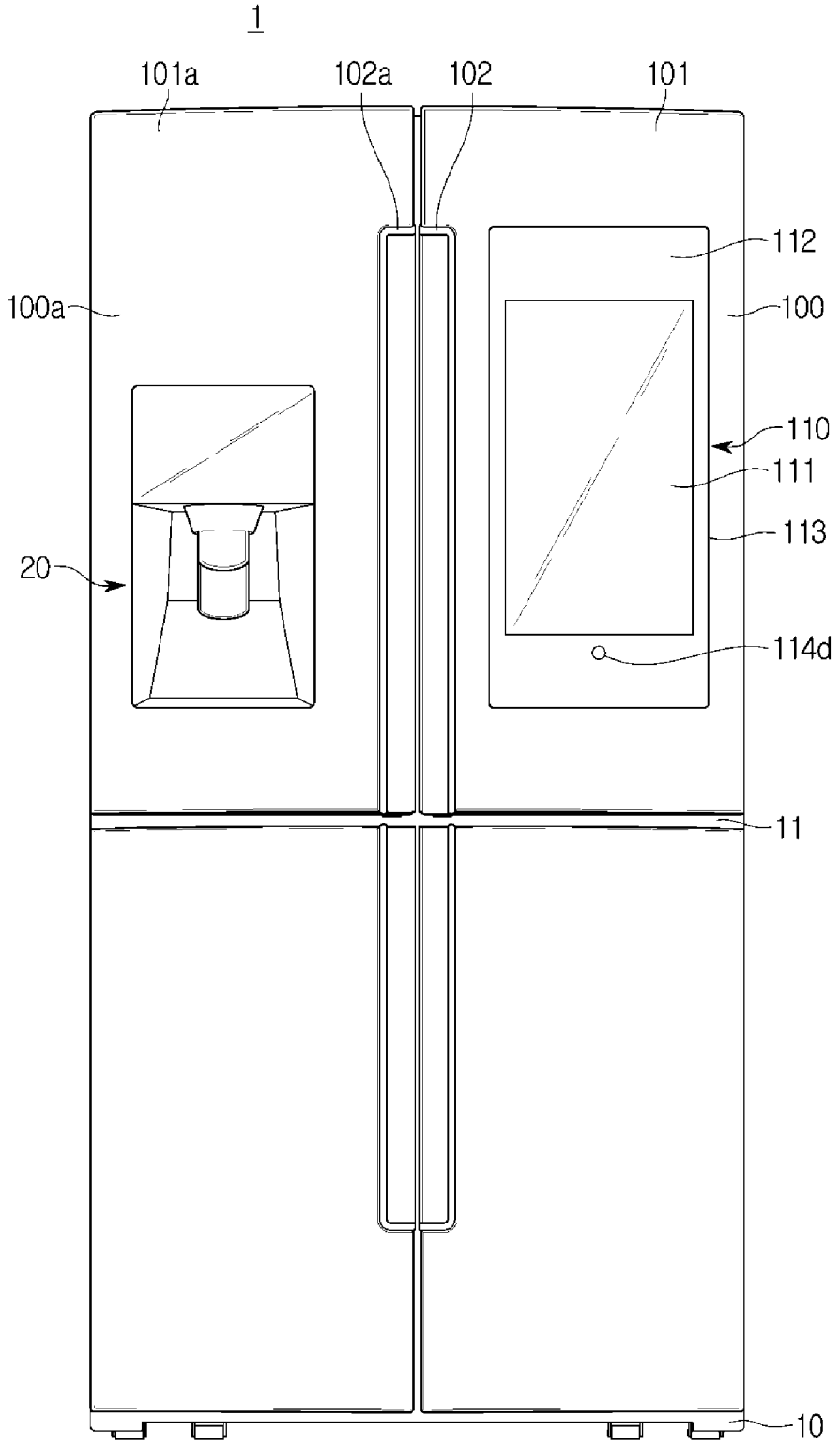
FIG. 1 is a view illustrating a refrigerator in accordance with one embodiment of the present disclosure.

The present disclosure will now be described more fully with reference to the accompanying drawings, in which exemplary embodiments of refrigerator 1 are shown. In the description of the present disclosure, if it is determined that a detailed description of commonly-used technologies or structures related to the embodiments of the present disclosure may unnecessarily obscure the subject matter of the invention, the detailed description will be omitted. The size of each element illustrated in the drawings is not illustrated in a real scale and the size of some element is exaggerated for clear expressions.

It will be understood that, although the terms first, second, third, etc., may be used herein to describe various elements, but elements are not limited by these terms. These terms are only used to distinguish one element from another element. For example, without departing from the scope of the present disclosure, a first element may be termed as a second element, and a second element may be termed as a first element.

In addition, "touch" may be generated by any one finger including the thumb or a touchable input unit (e.g. a stylus). "Touch" may further include "Hovering" by any one finger including the thumb or a touchable input unit. Further, "touch" may include a single touch or a multi-touch.

Referring to FIG. 1, according to one embodiment, a refrigerator 1 may include a body 10 configured to form an exterior; a storage chamber (not shown) provided to be divided into an upper side and a lower side inside of the body 10; and a door 100 configured to open or close the storage chamber.

The body 10 may form a storage chamber having a front surface open. The body 10 may include an inner case to form the storage chamber, an outer case coupled to the inner case to form the appearance of the refrigerator 1, and an insulation member foamed between the inner and outer cases, to insulate the storage chamber.

The storage chamber may be divided into an upper refrigerating compartment and a lower freezing compartment by a horizontal partition 11. Although FIG. 1 illustrates that the refrigerating compartment and the freezing compartment are opened or closed by a pair of the door 100, but is not limited thereto. The freezing compartment may be opened or closed by a sliding door.

The body 10 may include a cold air supplier configured to supply cold air to the storage chamber. The cold air supplier may generate cold air using a refrigeration cycle in which a refrigerant is compressed, condensed, expanded and evaporated.

The door 100 may be provided in a pair in the left and right side to open or close the storage chamber. In any one door 100*a* of the one pair of the door 100, a dispenser 20 may be provided to take purified water, carbonated water or ice from the outside without opening the door 100*a*, and in the other door 100, a display unit 110 may be provided to display information to a user. In this time, FIG. 1 illustrates that the dispenser 20 is disposed on the left door 100*a* and the display unit 110 is disposed on the right door 100, but is not limited thereto. The dispenser 20 may be disposed on the right door 100 and the display unit 110 may be disposed on the left door 100*a*. Alternatively, the dispenser 20 may be omitted.

On the one pair of the door 100 and 100*a*, a handle 102 and 102*a* configured to be held by a user may be provided on one side of a case 101 and 101*a* so that the user easily opens the storage chamber.

Hereinafter the door 100 in which the display unit 110 is provided will be described in details.

Figure 3:
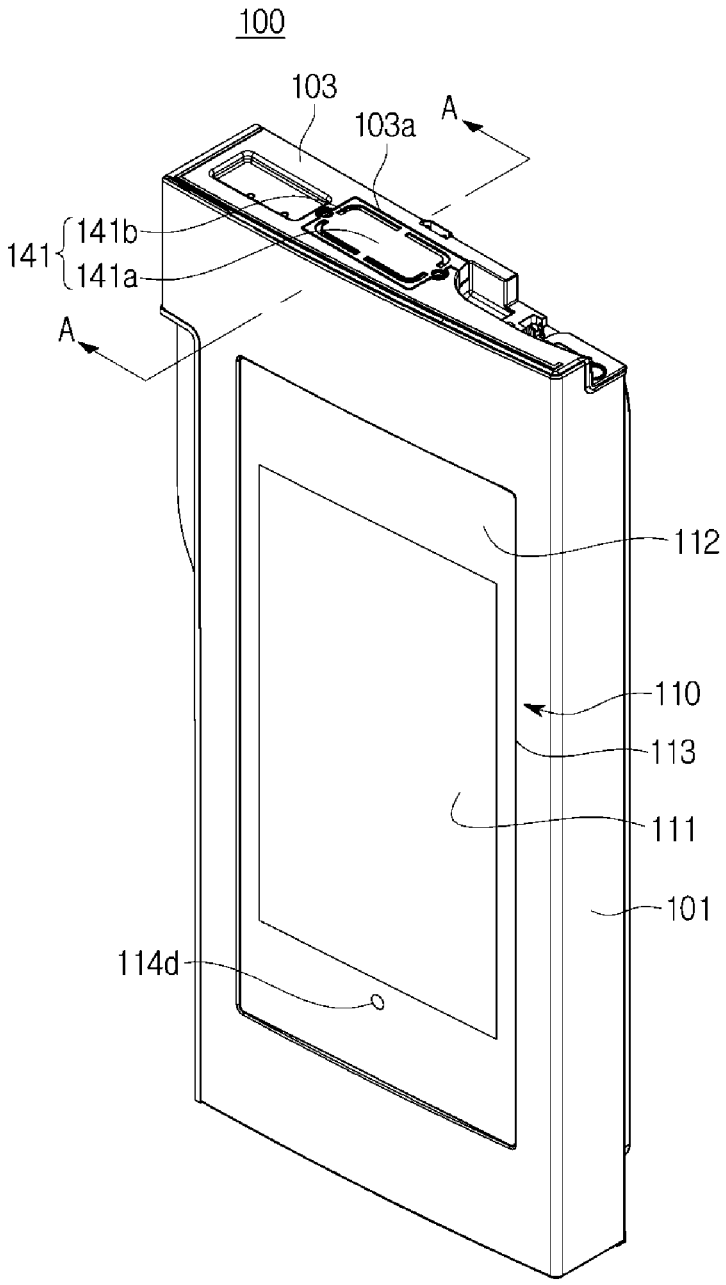
FIG. 3 is a perspective view illustrating a door of FIG. 1 when viewing from an upper front side.
Figure 4:
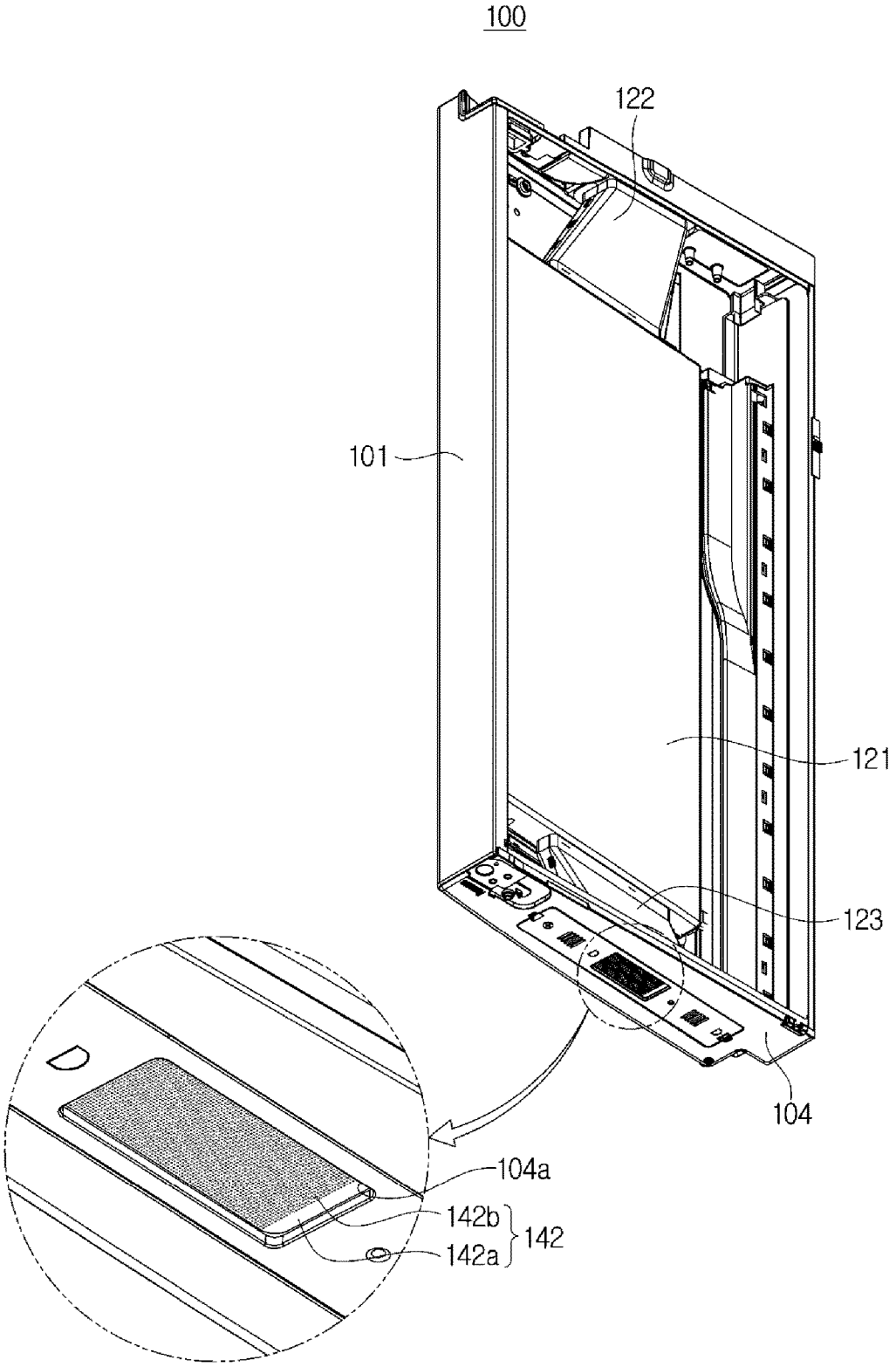
FIG. 4 is a perspective view illustrating the door of FIG. 3 when viewing from a lower rear side.

Referring to FIGS. 3 and 4, the door 100 may include the display unit 110 and a heat radiating unit 120. On an top surface 103 and a bottom surface 104 of the door 100, a first opening 103*a* and a second opening 104*a* may be provided to allow the heat radiating unit 120 to be communicated with the outside. The first opening 103*a* and the second opening 104*a* will be described in details with reference to the heat radiating unit 120.

Figure 5:
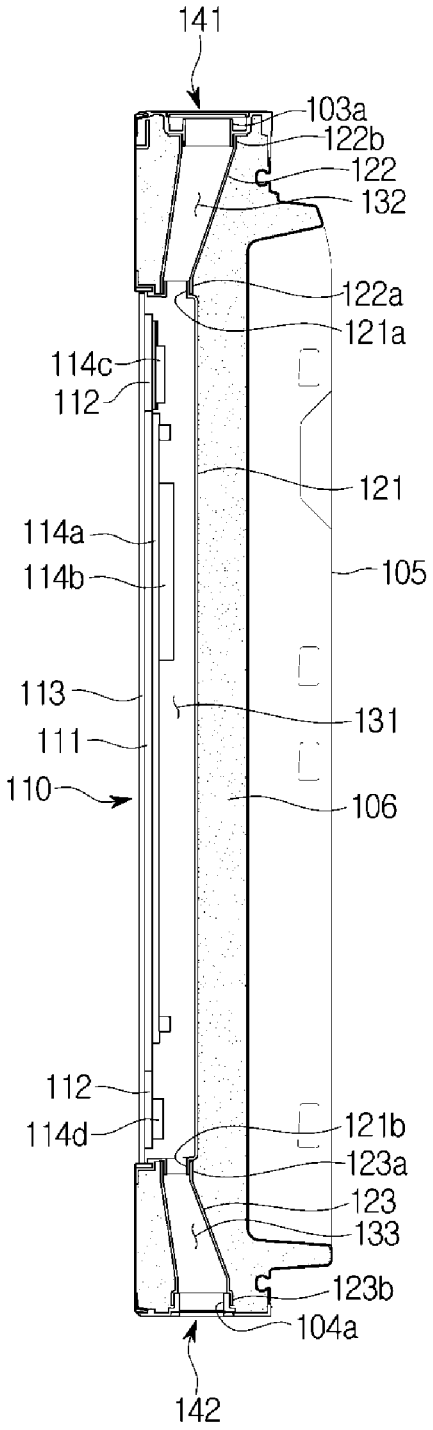
FIG. 5 is a cross-sectional view taken along line A-A' of FIG. 3.
Figure 6:
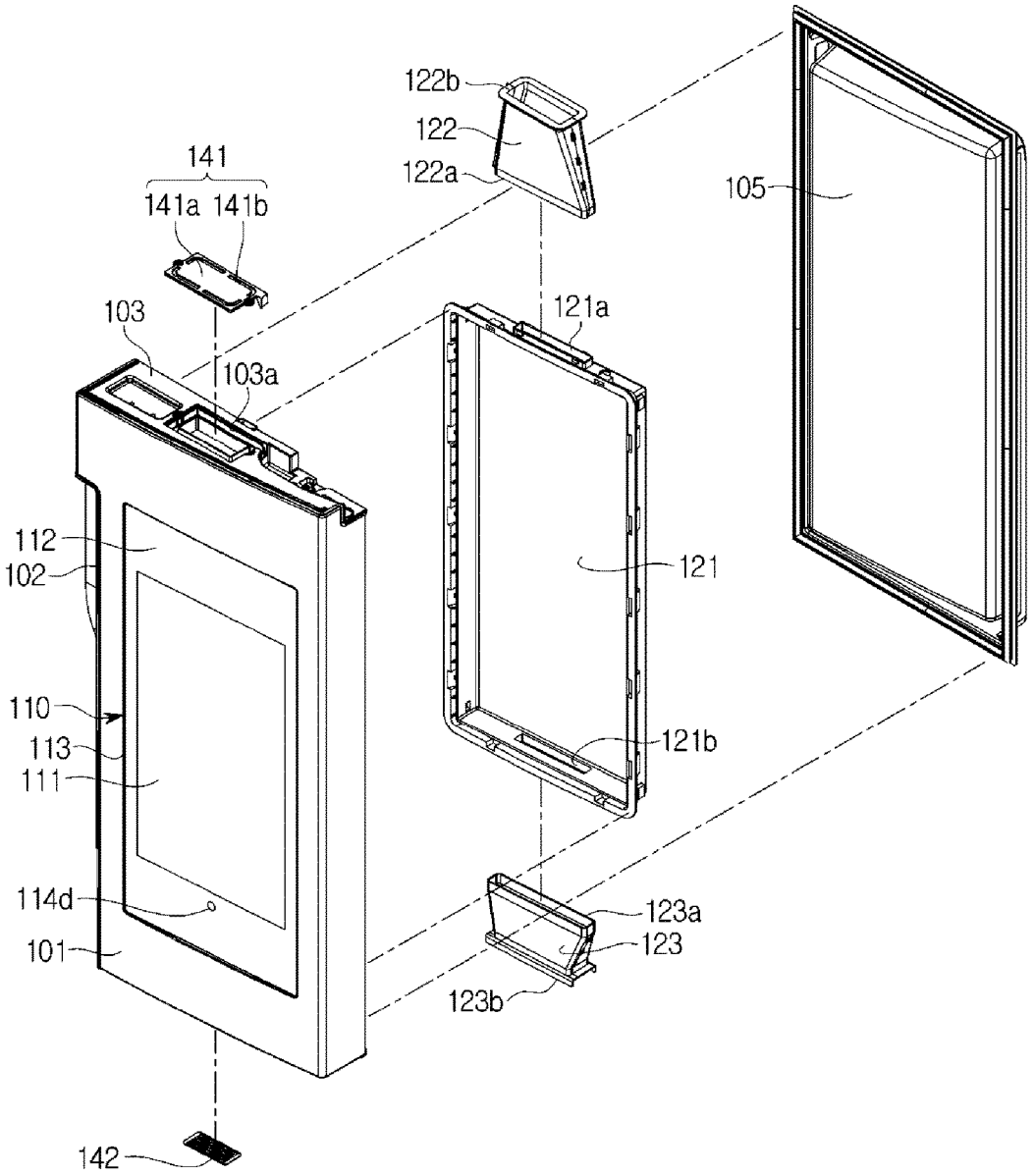
FIG. 6 is an exploded-perspective view illustrating the door of FIG. 3.
Figure 7:
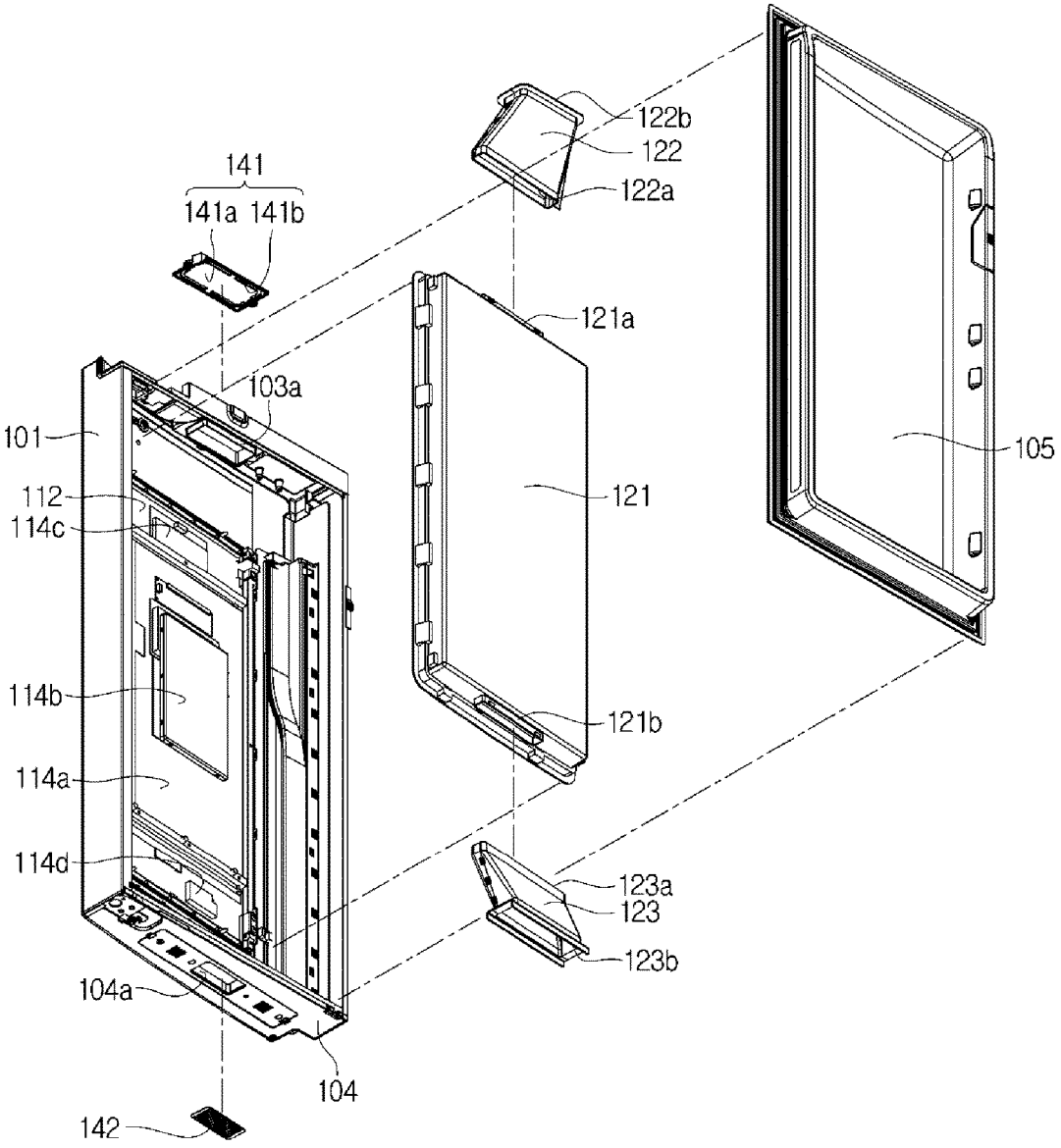
FIG. 7 is an exploded-perspective view illustrating the door of FIG. 4.

In addition, referring to FIGS. 5 to 7, in the door 100, an inner cover 105 may be disposed in a side of the storage chamber. A door rack (not shown) may be provided on the inner cover 105 so that beverages and food are stored thereon.

The door 100 may include an insulation member 106 foamed in an inner space made by the case 101 and the inner cover 105. The insulation member 106 may prevent cold air in the storage chamber from being discharged to the outside so that the inside of the storage chamber is maintained at a low temperature. In addition, the insulation member 106 may prevent an external heat from being delivered to the inside of the storage chamber.

Further, the display unit 110 may be provided such that an upper end thereof is disposed on the same line with an upper end of the handle 102 and a lower end thereof is disposed on the same line with a lower end of the dispenser 20. Due to the arrangement, the user may feel a comfort when using the display unit 110.

The display unit 110 disposed in the door 100 may be configured to display information to the user and the display unit 110 may include a display 111, a frame 112 and a glass 113.

The display 111 may be fixed by the frame 112 and configured to generate an image and then provide the image to the user. On a rear surface of the display 111, a plurality of electronic components 114 configured to operate the display unit 110 may be provided.

Particularly, the plurality of electronic components 114 provided in the rear surface of the display 111 may include a touch film 114*a* to allow a user to input a command by touching the display 111. In this case, the display 111 may be implemented by a touch screen to receive a command by the user's touch.

In addition, the plurality of electronic components 114 provided in the rear surface of the display 111 may be a mainboard 114*b* to operate the display unit 110.

The frame 112 may be provided along an edge portion of the display 111 to fix the display 111. Particularly, the display 111 may be mounted to the door 100 after being inserted into the frame 112. On a rear surface of the frame 112, the plurality of electronic components 114 configured to operate the display unit 110 may be provided.

Particularly, the plurality of electronic components 114 provided on the rear surface of the frame 112 may include a communication module 114*c* to allow the refrigerator 1 to perform the communication with the outside. By the communication module 114*c*, the refrigerator 1 may transmit and receive information to and from electronics having a communication module. For example, a user may control the refrigerator 1 via a terminal belonging to the user and control home appliances having a communication module via the refrigerator 1.

Figure 2:
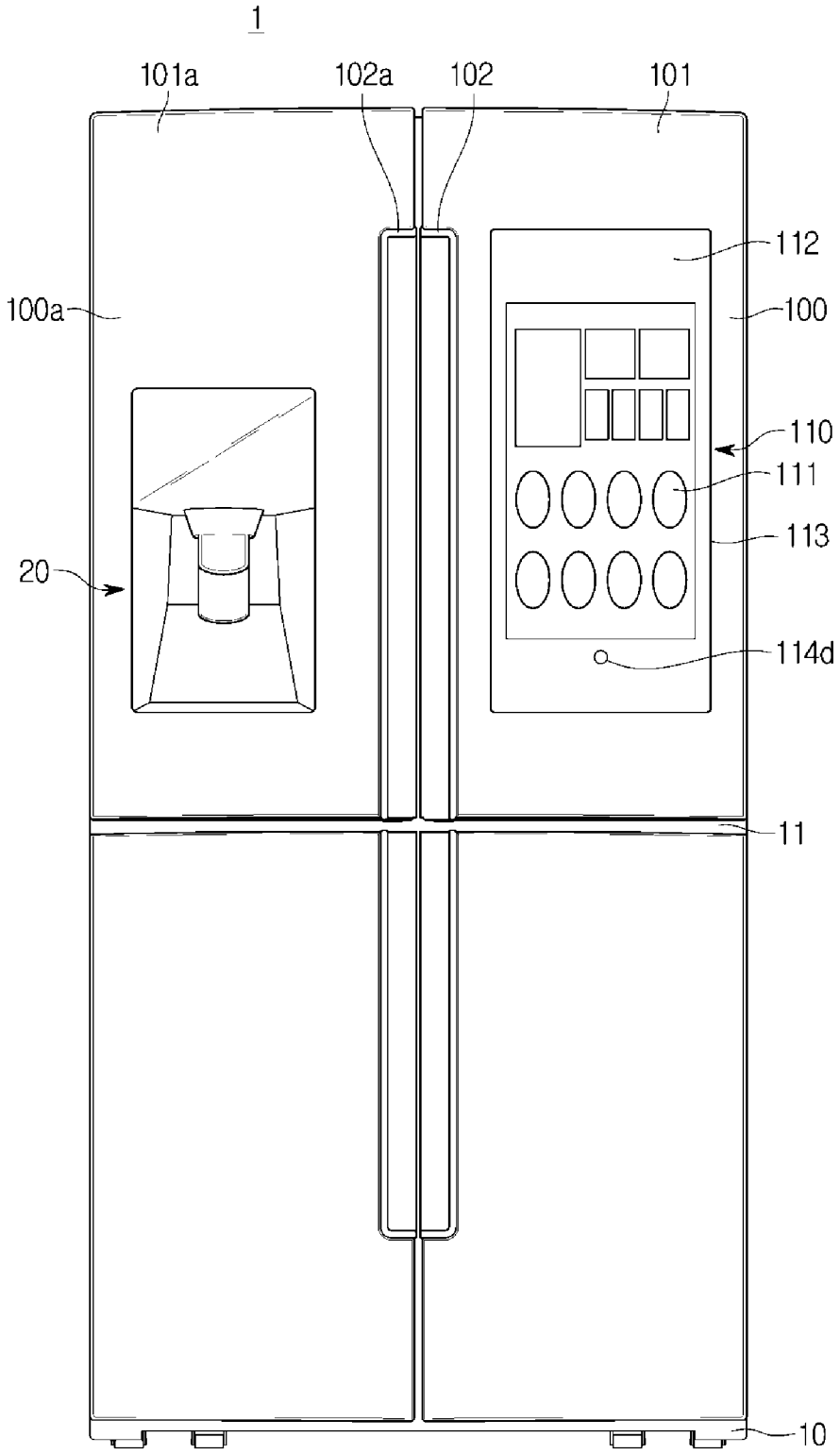
FIG. 2 is a view illustrating a state in which a display unit of the refrigerator of FIG. 1 is activated.

The plurality of electronic components 114 provided on the rear surface of the frame 112 may include a sensor 114*d* configured to detect the surroundings of the refrigerator 1 to selectively activate the display 111. For example, as illustrated in FIG. 1, when a user is not adjacent to the door 100 since the user does not use the refrigerator 1, the sensor 114*d* may inactivate the display 111 via a controller (not shown), and when a user is close to the door 100 since the user intends to use the refrigerator 1, the sensor 114*d* may activate the display 111 via the controller by detecting the user, as illustrated in FIG. 2. The sensor 114*d* may be a proximity sensor using an optical sensor.

The glass 113 may be disposed in a front side of the display 111 and the frame 112 to protect the display 111 and the frame 112. The glass 113 may be a high intensity glass.

Referring to FIGS. 4 and 5, the heat radiating unit 120 may be disposed adjacent to the display unit 110 to discharge a heat generated in the display unit 110 and include a heat radiating cover 121, a first heat radiating duct 122 and a second heat radiating duct 123.

The heat radiating cover 121 may be disposed to cover a rear surface of the display unit 110 so as to form a main flow path 131 receiving the heat generated in the display unit 110. Particularly, the heat radiating cover 121 may be provided to have a size corresponding to the size of the display unit 110 so that the heat radiating cover 121 covers the rear surface of the display unit 110 to completely receive the heat generated in the display unit 110.

The heat radiating cover 121 may be disposed between the display unit 110 and the insulation member 106. Accordingly, the heat generated in the display unit 110 may be discharged to the outside without being transmitted to the inside of the storage chamber, and thus the storage chamber may be maintained at a low temperature.

Further, referring to FIGS. 6 and 7, a first connection hole 121*a* of the heat radiating cover configured to be connected to the first heat radiating duct 122 may be provided in an upper surface of the heat radiating cover 121. The first connection hole 121*a* of the heat radiating cover 121 may be formed in a long-hole shape so that a heat transmitted from the display unit 110 may be efficiently discharged to the outside via the first heat radiating duct 122.

A second connection hole 121*b* of the heat radiating cover configured to be connected to the second heat radiating duct 123 may be provided in a lower surface of the heat radiating cover 121. The second connection hole 121*b* of the heat radiating cover may be formed in a long-hole shape as the same as the above mentioned first connection hole 121*a*.

Referring to FIGS. 6 and 7, the first heat radiating duct 122 may be connected to the upper surface of the heat radiating cover 121, so as to form a first auxiliary flow path 132 configured to discharge the heat transmitted to the heat radiating cover 121 to the outside. Particularly, the first heat radiating duct 122 may be disposed to pass through the insulation member 106 so that the heat generated in the display unit 110 is not transmitted to the front, rear, left and right side of the door 100. Accordingly, the heat generated in the display unit 110 may be discharged to only the upper side of the door 100 via the first heat radiating duct 122 without being transmitted to the side of the storage chamber, and thus the storage chamber may be maintained at a low temperature. In addition, since the heat is not transmitted to the front, left and right side of the door 100, it may be prevented that a user feels the displeasure caused by the heat of the door 100 when the user closes to the door 100.

A connection hole 122*a* of the first heat radiating duct 122 configured to be connected to the first connection hole 121*a* of the heat radiating cover 121 may be provided on one end portion of the first heat radiating duct 122 that is adjacent to the heat radiating cover 121, and a discharge port 122*b* of the first heat radiating duct 122 configured to be communicated with the outside by being connected to the first opening 103*a* formed in the top surface 103 of the door 100 may be provided on the other end portion of the first heat radiating duct 122 that is opposite to one end portion.

The first heat radiating duct 122 may have a cross sectional area being reduced as the connection hole 122*a* of the first heat radiating duct 122 that is adjacent to the heat radiating cover 121 becomes near to the discharge port 122*b* of the first heat radiating duct 122. Accordingly, the space for the insulation member 106 provided inside of the door 100 may be increased and the leakage of the cold air inside of the storage chamber may be minimized.

A first blocking unit 141 may be provided in the first opening 103*a* of the door 100 connected to the discharge port 122*b* of the first heat radiating duct 122 to prevent a foreign material having a large size from being introduced into the inside of the heat radiating unit 120. The first blocking unit 141 may include a blocker 141*a* preventing a large size foreign material from being introduced, and a through hole 141*b* through which external air is introduced to the heat radiating unit 120 and internal air is discharged from the heat radiating unit 120. Further, the first blocking unit 141 may be detachably installed in the top surface 103 of the door 100 so that the maintenance of the heat radiating unit 120 may be easily performed.

The second heat radiating duct 123 may be connected to the lower surface of the heat radiating cover 121, so as to form a second auxiliary flow path 133 configured to discharge the heat transmitted to the heat radiating cover 121 to the outside. Particularly, the second heat radiating duct 123 may be disposed to pass through the insulation member 106 so that the heat generated in the display unit 110 is not transmitted to the front, rear, left and right side of the door 100. Accordingly, the heat generated in the display unit 110 may be discharged to only the lower side of the door 100 via the second heat radiating duct 123 without being transmitted to the side of the storage chamber, and thus the storage chamber may be maintained at a low temperature. In addition, since the heat is transmitted to the front or left and right side of the door 100, it may be prevented that a user feels the displeasure caused by the heat of the door 100 when the user closes to the door 100.

A connection hole 123*a* of the second heat radiating duct 123 configured to be connected to the second connection hole 121*b* of the heat radiating cover 121 may be provided on one end portion of the second heat radiating duct 123 that is adjacent to the heat radiating cover 121, and a discharge port 123*b* of the second heat radiating duct 123 configured to be communicated with the outside by being connected to the second opening 104*a* formed in the bottom surface 104 of the door 100 may be provided on the other end portion of the second heat radiating duct 123 that is opposite to one end portion.

As similar with the first heat radiating duct 122, the second heat radiating duct 123 may have a cross sectional area being reduced as the connection hole 123*a* of the second heat radiating duct 123 that is adjacent to the heat radiating cover 121 becomes near to the discharge port 123*b* of the second heat radiating duct 123. Accordingly, the space for the insulation member 106 provided inside of the door 100 may be increased and the leakage of the cold air inside of the storage chamber may be minimized.

A second blocking unit 142 may be provided in the second opening 104*a* of the door 100 connected to the discharge port 123*b* of the second heat radiating duct 123 to prevent a foreign material having a large size from being introduced into the inside of the heat radiating unit 120. As similar with the above mentioned first blocking unit 141, the second blocking unit 142 may include a blocker 142*a* preventing a large size foreign material from being introduced, and a through hole 142*b* through which external air is introduced to the heat radiating unit 120 and internal air is discharged from the heat radiating unit 120. Further, the second blocking unit 142 may be detachably installed in the bottom surface 104 so that the maintenance of the heat radiating unit 120 may be easily performed.

As mentioned above, the heat generated in the display unit 110 may be discharged to the outside via the first heat radiating duct 122 and the second heat radiating duct 123 while external air at a low temperature is introduced into the heat radiating unit 120. However, in consideration with the air convection in which hot-air rises and cold air descends, air becoming a high temperature by the heat generated in the display unit 110 may be discharged to the outside via the first heat radiating duct 122, and external air at a low temperature may be introduced into the heat radiating unit 120 via the second heat radiating duct 123. Therefore, according to one embodiment, when opposite ends of the heat radiating unit 120 are connected to a hole formed in the upper and lower side, respectively, the efficiency of the radiation heat of the refrigerator 1 may be increased by the air convection.

Hereinafter according to one embodiment an operation of the refrigerator 1 configured as mentioned above will be described.

The user may move to a place adjacent to the door 100 of the refrigerator 1 to use the refrigerator 1. In this time, the sensor 114*d* provided in the door 100 may detect a fact that the user closes to the door 100 of the refrigerator 1 and then activate the display unit 110 via the controller (not shown), as illustrated in FIG. 2.

When the display unit 110 is activated, the user may receive information related to the status of the refrigerator 1 via the display unit 110, and further receive external information, e.g. weather information, and news information, via the communication module 114*c*. Further, when the display 111 is implemented by a touch screen, the user may input a command by touching the display 111. The command may include a command to control the refrigerator 1 or a command to control electronics provided with a communication module.

Referring to FIG. 3, as the display unit 110 is used by the user, the display unit 110 may generate a heat. The heat may be transmitted to the main flow path 131 formed by the heat radiating cover 121 of the heat radiating unit 120. The heat transmitted to the main flow path 131 may increase a temperature of air inside of the heat radiating unit 120. The air at a high temperature may be mostly discharged to the outside via the first opening 103*a* formed in the top surface 103 of the door 100 after passing through the first auxiliary flow path 132 formed by the first heat radiating duct 122, and the remaining of the air may be discharged to the outside via the second opening 104*a* formed in the bottom surface 104 of the door 100 after passing through the second auxiliary flow path 133 formed by the second heat radiating duct 123.

As the internal air of the heat radiating unit 120 is discharged to the outside, the external air may be introduced into the heat radiating unit 120. As mentioned above, since the air at a high temperature is mostly discharged to the outside via the first opening 103*a* formed in the top surface 103 of the door 100, the external air at a relative low temperature may be mostly introduced into the heat radiating unit 120 via the second opening 104*a* formed in the bottom surface 104 of the door 100. The remaining air of the external air may be introduced into the inside via the first opening 103*a* formed in the top surface 103 of the door 100.

As a result, the heat generated by the operation of the display unit 110 may be discharged to the outside by the internal air and the external air which circulate the main flow path 131, the first and second auxiliary flow path 132 and the second auxiliary flow path 133 according to the air convection.

As mentioned above, according to the embodiment of the present disclosure, since the refrigerator 1 discharges the heat generated by the display unit 110 to the outside by circulating the external air and the internal air using the air convection, an additional blower may be not needed and thus the noise may be reduced. In addition, the structure of the heat radiation may be simplified and thus the efficiency of the heat radiation may be improved and the electricity consumption of the refrigerator 1 may be reduced.

Although a few embodiments of the present disclosure have been shown and described, it would be appreciated by those skilled in the art that changes may be made in these embodiments without departing from the principles and spirit of the disclosure, the scope of which is defined in the claims and their equivalents.

The invention claimed is:

1. A refrigerator comprising:

a body provided with a storage chamber;

a door configured to open or close the storage chamber, the door including an insulation member;

a display provided on the door; and a heat radiating member configured to radiate heat generated in the display via a heat radiating flow path formed by a heat radiating cover, a first heat radiating duct and a second heat radiating duct;

wherein one end of the heat radiating flow path communicates with an outside via a first opening formed in a top surface of the door, and another end of the heat radiating flow path communicates with the outside via a second opening formed in a bottom surface of the door, the heat radiating cover is disposed to cover a rear side of the display, the first heat radiating duct extending from the heat radiating cover to the first opening, and the second heat radiating duct extending from the heat radiating cover to the second opening, and the insulation member is provided in each region between a front surface of the door and the first heat radiating duct, between a rear surface of the door and the first heat radiating duct, between the front surface of the door and the second heat radiating duct, and between the rear surface of the door and the second heat radiating duct.

2. The refrigerator of claim 1, wherein a blocking member provided with a blocker configured to prevent a foreign material from being introduced into the heat radiating flow path and a through hole configured to allow air to be passed therethrough in at least one of the first opening and the second opening.

3. The refrigerator of claim 2, wherein the blocking member is detachably installed in the door.

4. The refrigerator of claim 1, wherein the heat radiating flow path comprises a main flow path receiving the heat generated from the display and an auxiliary flow path discharging the heat transmitted from the main flow path to the outside via the first opening and second opening.

5. The refrigerator of claim 4, wherein the heat radiating cover forms the main flow path, and the first heat radiating duct and the second heat radiating duct form the auxiliary flow path.

6. The refrigerator of claim 1, wherein the display is provided with a sensor to selectively activate the display.

7. The refrigerator of claim 1, wherein the display comprises a touch screen.

8. A refrigerator comprising:

a body provided with a storage chamber;

a door configured to open or close the storage chamber, the door including an insulation member;

a display provided on the door; and a heat radiating member disposed adjacent to the display, the heat radiating member being configured to radiate a heat generated in the display via a heat radiating flow path formed to have a part passing through the insulation member to communicate with an outside, wherein the heat radiating member comprises:

a heat radiating cover disposed to cover a rear side of the display, a first heat radiating duct extending in an upper side and a lower side direction such that the heat radiating cover is communicated with a first opening formed in a top surface of the door, and a second heat radiating duct extending in an upper side and a lower side direction such that the heat radiating cover is communicated with a second opening formed in a bottom surface of the door, wherein the insulation member is provided in each region between a front surface of the door and the first heat radiating duct, between a rear surface of the door and the first heat radiating duct, between the front surface of the door and the second heat radiating duct, and between the rear surface of the door and the second heat radiating duct.

9. The refrigerator of claim 8 wherein the heat radiating cover is disposed between the display and the insulation member, and the first heat radiating duct is disposed to pass through the insulation member.

* * * * *